US010138012B2

(12) United States Patent
Koskela et al.

(10) Patent No.: US 10,138,012 B2
(45) Date of Patent: Nov. 27, 2018

(54) APPARATUS FOR FIXING AND RELEASING THE END OF A ROLL OF WRAPPING FILM

(71) Applicant: Signode Industrial Group LLC, Glenview, IL (US)

(72) Inventors: Janne Koskela, Turku (FI); Yrjö Suolahti, Mynämäki (FI)

(73) Assignee: Signode Industrial Group LLC, Glenview, IL (US)

( * ) Notice: Subject to any disclaimer, the term of this patent is extended or adjusted under 35 U.S.C. 154(b) by 1045 days.

(21) Appl. No.: 14/524,599

(22) Filed: Oct. 27, 2014

(65) Prior Publication Data

US 2015/0113920 A1 Apr. 30, 2015

(30) Foreign Application Priority Data

Oct. 31, 2013 (FI) ..... 20136065

(51) Int. Cl.

| | |
|---|---|
| ***B65B 11/00*** | (2006.01) |
| ***B65B 45/00*** | (2006.01) |
| ***B65B 61/06*** | (2006.01) |
| ***F16B 45/04*** | (2006.01) |
| ***B65B 11/02*** | (2006.01) |
| *B65B 41/12* | (2006.01) |

(52) U.S. Cl.

CPC ..... *B65B 45/00* (2013.01); *B65B 11/025* (2013.01); *B65B 61/06* (2013.01); *F16B 45/04* (2013.01); *B65B 41/12* (2013.01); *B65B 2210/18* (2013.01); *Y10T 24/44966* (2015.01)

(58) Field of Classification Search

CPC ..... B65B 45/00; B65B 13/02; B65B 11/00

See application file for complete search history.

(56) References Cited

U.S. PATENT DOCUMENTS

| | | | |
|---|---|---|---|
| 2,711,803 | A | 6/1955 | Hurst et al. |
| 2,745,688 | A | 5/1956 | Farrington et al. |
| 2,758,898 | A | 8/1956 | Kobsch |
| 2,797,634 | A | 7/1957 | Rueckert |
| 2,942,797 | A | 6/1960 | Lorenz et al. |
| 3,016,869 | A | 1/1962 | Anderson et al. |
| 3,190,457 | A | 6/1965 | Linden |
| 3,278,059 | A | 10/1966 | Ridgeway et al. |
| 3,436,046 | A | 4/1969 | Valeska |

(Continued)

FOREIGN PATENT DOCUMENTS

| | | |
|---|---|---|
| CN | 101 830 292 | 9/2010 |
| DE | 2256753 | 5/1974 |

(Continued)

OTHER PUBLICATIONS

Finish Opinion on Patentability and Search Report for Finnish Application No. 20136065 dated Jul. 9, 2014 (5 pages).

(Continued)

*Primary Examiner* — Gloria R Weeks

(74) *Attorney, Agent, or Firm* — Neal, Gerber & Eisenberg LLP

(57) ABSTRACT

Various embodiments of the present disclosure provide a new method and apparatus for fixing the end of a roll of wrapping film web to and releasing the end of the roll of wrapping film end from a circular guide wrapping machine when a new roll of wrapping film web is installed or when the wrapping film web has torn apart.

20 Claims, 2 Drawing Sheets

(56) References Cited

U.S. PATENT DOCUMENTS

| | | | | |
|---|---|---|---|---|
| 3,507,137 | A | 4/1970 | Taleff et al. | |
| 3,626,654 | A | 12/1971 | Hoffler et al. | |
| 3,679,244 | A | 7/1972 | Reddy | |
| 3,852,937 | A | 12/1974 | Bitsura et al. | |
| 3,902,303 | A | 9/1975 | King | |
| 3,944,045 | A | 3/1976 | Higgins | |
| 4,063,401 | A | 12/1977 | Higgins | |
| 4,067,174 | A | 1/1978 | Goldstein | |
| 4,204,377 | A | 5/1980 | Lancaster et al. | |
| 4,235,062 | A | 11/1980 | Lancaster, III et al. | |
| 4,317,322 | A | 3/1982 | Lancaster et al. | |
| 4,473,990 | A | 10/1984 | Thimon | |
| 4,587,796 | A | 5/1986 | Haloila | |
| 4,588,142 | A | 5/1986 | Malzacher | |
| 4,619,193 | A | 10/1986 | Crew | |
| 4,631,898 | A | 12/1986 | Brambilla | |
| 4,754,594 | A | 7/1988 | Lancaster | |
| 4,756,143 | A | 7/1988 | Lancaster | |
| 4,905,451 | A | 3/1990 | Jaconelli et al. | |
| 4,905,488 | A | 3/1990 | Plitt | |
| 4,914,891 | A | 4/1990 | Suolahti | |
| 4,939,989 | A | 7/1990 | Zacharias | |
| 5,107,657 | A | 4/1992 | Diehl et al. | |
| 5,140,795 | A | 8/1992 | Steding | |
| 5,154,382 | A | 10/1992 | Hoshino | |
| 5,195,297 | A | 3/1993 | Lancaster et al. | |
| 5,216,871 | A | 6/1993 | Hannen | |
| 5,452,566 | A * | 9/1995 | Benhamou | B65B 11/025 53/389.3 |
| 5,463,843 | A | 11/1995 | Sharp | |
| 5,619,838 | A | 4/1997 | Kasel | |
| 5,623,808 | A | 4/1997 | Franklin et al. | |
| 6,032,439 | A | 3/2000 | Birkenfeld et al. | |
| 6,237,307 | B1 | 5/2001 | Zentmyer et al. | |
| 6,298,636 | B1 | 10/2001 | Lachenmeier et al. | |
| 6,470,654 | B1 | 10/2002 | Lachenmeier et al. | |
| 6,516,591 | B1 | 2/2003 | Lancaster, III et al. | |
| 6,539,690 | B2 | 4/2003 | Alvarez | |
| 6,619,872 | B2 | 9/2003 | Crorey et al. | |
| 6,622,620 | B1 | 9/2003 | Byington | |
| 6,865,865 | B2 | 3/2005 | Hannen et al. | |
| 6,945,163 | B2 | 9/2005 | Squyres | |
| 7,036,289 | B2 | 5/2006 | Suolahti | |
| 7,040,076 | B2 | 5/2006 | Lachenmeier et al. | |
| 7,234,289 | B2 | 6/2007 | Hannen et al. | |
| 7,325,487 | B2 | 2/2008 | Squyres | |
| 7,367,740 | B2 | 5/2008 | Lazic et al. | |
| 7,533,515 | B1 | 5/2009 | Koskela | |
| 7,707,801 | B2 | 5/2010 | Lancaster, III | |
| 7,707,802 | B2 | 5/2010 | Forrest | |
| 7,908,831 | B1 | 3/2011 | Dugan | |
| 7,913,476 | B2 | 3/2011 | Lachenmeier | |
| 7,937,910 | B2 | 5/2011 | Jaconelli et al. | |
| 7,966,790 | B2 | 6/2011 | Michels et al. | |
| 7,975,456 | B2 | 7/2011 | Lachenmeier et al. | |
| 8,141,327 | B2 | 3/2012 | Lancaster, III | |
| 8,347,784 | B2 | 1/2013 | Herrmann | |
| 8,453,420 | B2 | 6/2013 | Schmidt et al. | |
| 8,695,312 | B2 * | 4/2014 | Johnson | B65B 11/025 269/32 |
| 8,875,480 | B2 | 11/2014 | Czok | |
| 9,290,285 | B2 * | 3/2016 | Johnson | B65B 11/025 |
| 2001/0046409 | A1 | 11/2001 | Fischer | |
| 2002/0033005 | A1 | 3/2002 | Lachenmeier et al. | |
| 2003/0156891 | A1 | 8/2003 | Hung et al. | |
| 2004/0107677 | A1 | 6/2004 | Hannen et al. | |
| 2006/0005511 | A1 | 1/2006 | Suolahti et al. | |
| 2006/0040085 | A1 | 2/2006 | Downs et al. | |
| 2006/0285915 | A1 | 12/2006 | Dellach et al. | |
| 2007/0157557 | A1 | 7/2007 | Lancaster, III | |
| 2007/0163207 | A1 | 7/2007 | Chiu Chen | |
| 2009/0217624 | A1 | 9/2009 | Forrest | |
| 2009/0229226 | A1 | 9/2009 | Beeland et al. | |
| 2009/0293425 | A1 | 12/2009 | Carter et al. | |
| 2010/0018165 | A1 | 1/2010 | Kudia | |
| 2010/0037562 | A1 * | 2/2010 | Forni | B65B 11/045 53/461 |
| 2010/0071317 | A1 | 3/2010 | Michels et al. | |
| 2010/0163443 | A1 | 7/2010 | Storig et al. | |
| 2010/0258241 | A1 | 10/2010 | Perecman | |
| 2011/0258973 | A1 | 10/2011 | Czok et al. | |
| 2014/0013714 | A1 | 1/2014 | Lachenmeier et al. | |
| 2014/0053502 | A1 | 2/2014 | Pecchenini et al. | |
| 2014/0137516 | A1 | 5/2014 | Lachenmeier et al. | |
| 2014/0250831 | A1 | 9/2014 | Suolahti et al. | |
| 2015/0232214 | A1 | 8/2015 | Suolahti et al. | |
| 2015/0251792 | A1 | 9/2015 | Koskela et al. | |
| 2017/0057677 | A1 * | 3/2017 | Terenzi | B65B 45/00 |

FOREIGN PATENT DOCUMENTS

| | | |
|---|---|---|
| DE | 3101310 | 12/1981 |
| DE | 3918311 | 12/1989 |
| DE | 3914595 | 11/1990 |
| DE | 200 12 889 U1 | 1/2001 |
| DE | 20101909 | 6/2002 |
| DE | 102005037916 | 5/2006 |
| DE | 10 2005 062 609 | 7/2007 |
| DE | 20 2007 018 900 | 8/2009 |
| DE | 102010037770 | 6/2012 |
| DE | 10 2011 000 205 | 7/2012 |
| DE | 10 2012 024 176 | 6/2014 |
| EP | 0 293 352 A2 | 11/1988 |
| EP | 0 621 184 | 10/1994 |
| EP | 0 653 352 | 5/1995 |
| EP | 0 811 554 | 12/1997 |
| EP | 1 033 305 | 9/2000 |
| EP | 1 097 867 | 5/2001 |
| EP | 1 266 828 | 12/2002 |
| EP | 1 266 829 | 12/2002 |
| EP | 1 454 827 | 9/2004 |
| EP | 1 542 192 | 6/2005 |
| EP | 1 574 432 | 9/2005 |
| EP | 2 060 492 | 5/2009 |
| EP | 2 069 209 | 6/2009 |
| EP | 2 199 214 | 6/2010 |
| EP | 2 792 599 | 10/2014 |
| FI | 78433 | 4/1989 |
| FI | 91624 | 4/1994 |
| FR | 1 396 355 | 4/1965 |
| GB | 2 395 165 | 5/2004 |
| JP | 2002104308 | 4/2002 |
| JP | 2013154956 | 8/2013 |
| WO | WO 02/12065 A1 | 2/2002 |
| WO | WO 02/812065 | 2/2002 |
| WO | WO 2004/045952 | 6/2004 |
| WO | 2006/110596 | 10/2006 |
| WO | 2008/031449 | 3/2008 |
| WO | WO 2008/059359 A2 | 5/2008 |
| WO | 2010/078915 | 7/2010 |
| WO | 2012/027705 | 3/2012 |

OTHER PUBLICATIONS

French National Institute of Intellectual Property, Search Report for co-pending French Patent Application No. FR 1460340, dated Oct. 24, 2017 (7 pages).

* cited by examiner

APPARATUS FOR FIXING AND RELEASING THE END OF A ROLL OF WRAPPING FILM

PRIORITY CLAIM

This patent application claims priority to and the benefit of Finland Patent Application Serial No. 20136065, filed on Oct. 31, 2013, the entire contents of each of which are incorporated herein by reference.

BACKGROUND

The present disclosure relates to attaching an end of a wrapping film web to a wrapping machine when: (a) a roll of wrapping film web needs to be changed, such as when a new roll of wrapping film web needs to be installed; or (b) the wrapping film web is torn apart such that the wrapping process may continue.

Various types of wrapping machines for wrapping a web-type plastic film around an article being packaged are known. The article being packaged is typically a pallet-mounted load that usually takes the form of a rectangular parallelepiped.

In certain known wrapping machines, the plastic film web is wrapped around the load by: (a) rotating rolls of plastic film web around the pallet, (b) rotating the pallet with respect to the rolls of plastic film web, or (c) both (a) and (b) at the same time. The rolls of plastic film web are also simultaneously shifted in the vertical direction. These known wrapping machines are also typically fitted with elements configured to provide a piece of plastic film web to cover a top surface of the load to be wrapped.

During the wrapping process, the film is usually also pre-stretched to a certain degree before being wrapped around the load. The stretched film provides secure protection of the wrapped load and helps keep the wrapped products at their places on the pallet. Stretching the film also reduces the thickness of the film and, therefore, less film material is used in wrapping the load, which reduces material costs.

One way of moving rolls of film web around a stationary pallet and a load thereon is to provide the wrapping machine with a horizontally placed, ring-shaped circular guide structure that is fitted with one or more film supply carriages including a roll of film web. Such a circular guide structure can be formed, for example, from a circular guide ring mounted on a frame of the wrapping machine in a vertically movable manner and a circular guide ring that is fitted with film supply carriages and that is rotatable relative to the stationary circular guide ring. Alternatively, the circular guide structure of the wrapping machine may include only one circular guide ring that is either rotatably or non-rotatably mounted on the frame of the wrapping machine and that is also movable in the vertical direction. One known wrapping machine using circular guides is described in U.S. Pat. No. 4,587,796.

In known circular guide wrapping machines in which the wrapping film web is wrapped around a stationary load with a movable film web roll carriage, the end of the film web is generally caught in a cutting and holding device of the wrapping machine. The cutting and holding device ends the wrapping process by cutting the film web and fixing the end of the wrapped film web to the wrapped load. When a new wrapping process is started, the cutting and holding device releases the end of the film web. Generally, the cutting and holding deice does so after the first round of the film web is wrapped on the load or at another suitable time during the first wrapping rounds such that the wrapping process may continue without fear that the film web will detach itself from the load to be wrapped and the released end remains under the subsequent wrapping rounds. Thus, the wrapping machine may proceed to start wrapping a new load immediately after the new load is set in the wrapping area for wrapping without any required steps for attaching the end of the film web to the new load.

However, in cases in which: (a) a roll of wrapping film web needs to be changed, such as when a new roll of wrapping film web needs to be installed; or (b) the wrapping film web is torn apart, the free end of the film web needs to be fixed to the cutting and holding device such that the wrapping process may be started again. This reattachment process of the end of the film web to the cutting and holding device is problematic since the cutting and holding device is located in the wrapping area of the wrapping machine in which a load to be wrapped is typically present, which limits accessibility to the cutting and holding device. Additionally, the film carriage to which the roll of the wrapping film web is installed is often located in front of the cutting and holding device during the roll changing process, which further limits accessibility to the cutting and holding device. Further, the actual reattachment of the end of the film web requires use of both hands to open the required parts of the cutting and holding device and to close them again to fix the end of the film web to the cutting and holding device. Thus, the reattachment process of the end of the film web to the cutting and holding device is burdensome to a person who needs to do so.

There exists a need for new and improved methods and apparatuses for fixing the end of a wrapping film web to and releasing the end of the wrapping film web from a circular guide wrapping machine.

SUMMARY

Various embodiments of the present disclosure provide a new method and apparatus for fixing the end of a roll of wrapping film web to and releasing the end of the roll of wrapping film end from a circular guide wrapping machine when: (a) a roll of wrapping film web needs to be changed, such as when a new roll of wrapping film web needs to be installed; or (b) the wrapping film web is torn apart. The method and apparatus of the present disclosure is easy and simple to use and overcomes many of the above-described drawbacks of the traditional methods.

In one embodiment, the wrapping machine of the present disclosure includes a circular guide along which a roll of wrapping film web is movable, a cutting and holding device configured to cut the wrapping film web and hold an end of the wrapping film web, and a fixing device separate from the cutting and holding device. In this embodiment, the fixing device is configured to hold the end of the wrapping film web and release the end of the wrapping film web after the wrapping machine has begun wrapping the wrapping film web around an object.

More specifically, in this embodiment, the fixing device includes a body defining a groove therethrough; a releaser supported by the body, wherein the releaser is movable relative to the body between a first position and a second position; and an actuator supported by the body and configured to move the releaser between the first position and the second position. In this embodiment, the releaser covers substantially all of the groove when the releaser is in the second position and less than all of the groove when the releaser is in the first position.

In operation of this embodiment, a user attaches the end of the wrapping film web to the fixing device by first tying a knot in the end of the wrapping film web. With the releaser of the fixing device in the first position, the user then slides the end of the wrapping film web into the groove such that the knot prevents the end of the wrapping film web from escaping the groove. The wrapping machine then wraps the wrapping film web around an object at least once. Thereafter, to release the end of the wrapping film web from the fixing device, the actuator moves the releaser of the fixing device from the first position to second position, which pushes the end of the wrapping film web from the groove and releases the end of the wrapping film web from the fixing device. The wrapping machine then continues wrapping the wrapping film web around the object to secure the released end of the wrapping film web.

The use of the separate fixing device enables the end of the wrapping film web to be manually attached easily and quickly (with one hand for example) to the structure of the wrapping machine and to be automatically released from the structure of the wrapping machine. This hastens the changing process when a new roll of the wrapping film web needs to be installed in the wrapping machine and thus shortens the required downtime.

In another embodiment, an end of a roll of wrapping film web is attached to a wrapping machine, which wrapping machine includes: (a) a substantially horizontal circular guide along which the roll of wrapping film web is circulated, and (b) a cutting and holding device for cutting the wrapping film web and holding the end of the wrapping film web after a process of wrapping a load has ended. In a situation in which the roll of wrapping film web has been changed (such as when a new roll of wrapping film web has been installed) or in a similar situation in which the end of the wrapping film web is not automatically attached to the cutting and holding device for starting or continuing the wrapping process, the end of the wrapping film web is manually attached to a separate fixing device located within the wrapping area of the wrapping machine. The fixing device releases the end of the wrapping film web after the wrapping process has been started.

In another embodiment, a knot is tied in the end of the wrapping film web, after which the end of the wrapping film web is set in a groove in the fixing device such that the knot keeps the end of the wrapping film web fixed to the fixing device. Further, in this embodiment the end of the wrapping film web is released from the fixing device advantageously by moving the knot from the area of the groove.

In one embodiment, the end of the wrapping film web is advantageously released from the fixing device substantially at same time during the wrapping process than with the cutting and holding device. Normally this releasing takes place after the first, or at a suitable time during the first couple, of rounds of the wrapping material being wrapped around the load to be wrapped.

In another embodiment, the fixing device to which an end of a roll of wrapping film web may be attached is part of a wrapping machine. The wrapping machine further includes: (a) a substantially horizontal circular guide along which the roll of wrapping film web is circulated, and (b) a cutting and holding device for cutting the wrapping film web and holding the end of the wrapping film web after a process of wrapping a load has ended. The fixing device includes a groove for holding the end of the wrapping film web and means for releasing the end of the wrapping film web.

In one embodiment, the means for releasing the end of the wrapping film web of the fixing device includes an advantageously linear movement actuator for moving the end of the wrapping film web from the area of the groove. Suitable linear actuators comprise, for example, pneumatic and hydraulic cylinders and linear motors.

In another embodiment, the wrapping machine comprises: (a) a substantially horizontal circular guide along which a roll of wrapping film web is circulated, (b) a cutting and holding device for cutting the wrapping film web and holding the end of the wrapping film web after a process of wrapping a load has ended, and (c) a separate fixing device in the wrapping area of the wrapping machine for holding the end of the wrapping film web when the roll of wrapping film web is changed (such as when a new roll of wrapping film web is installed) or a similar situation exists in which the end of a wrapping film web is not automatically fixed to the cutting and holding device. The fixing device is configured to release the end of the wrapping film web after the wrapping process is started.

In one embodiment of the wrapping machine, the fixing device advantageously comprises a groove for holding the end of the wrapping film web and means for releasing the end of the wrapping film web.

In one embodiment of the wrapping machine, the means for releasing the end of the wrapping film web of the fixing device comprises a linear movement actuator for moving the end of the wrapping film web from the area of the groove.

Additional features and advantages are described in, and will be apparent from, the following Detailed Description and the Figures.

DETAILED DESCRIPTION

Figure 1:
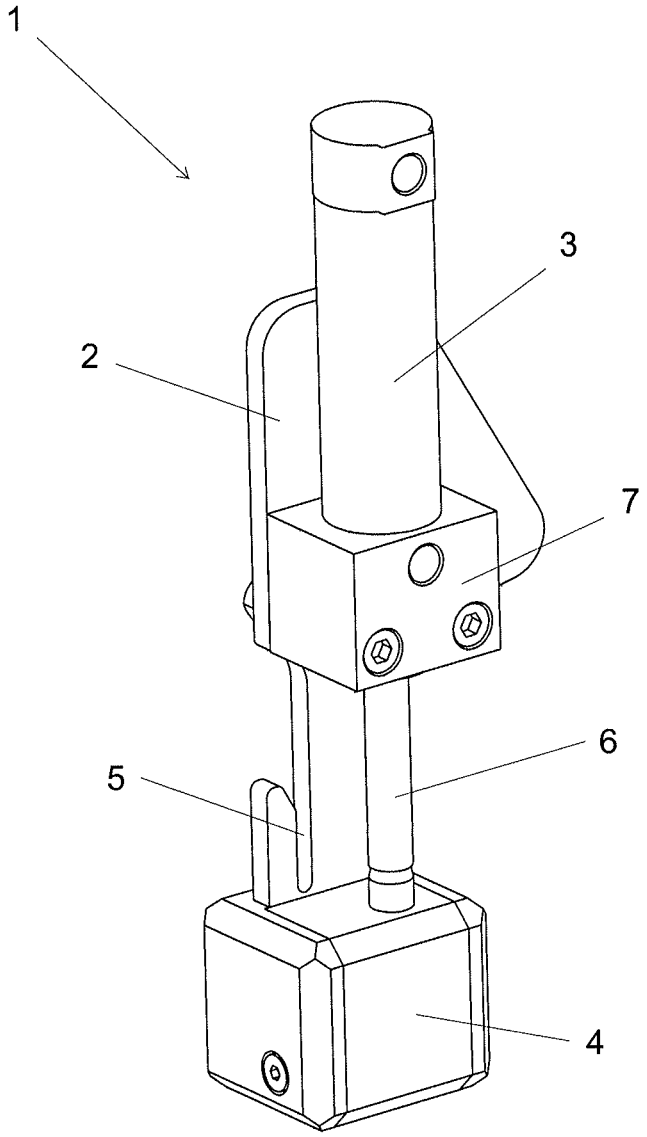
FIG. 1 is a perspective view of one embodiment of the fixing device of the present disclosure.

FIG. 1 illustrates one embodiment of a fixing device 1 of the present disclosure for attaching an end of a wrapping film web in a wrapping machine. The fixing device 1 includes: (a) a body part or body 2; (b) an actuator, such as a pneumatic cylinder 3; (c) a releasing part or releaser 4; (d) a groove 5; (e) a shaft 6; and (f) a connection part or connector 7.

The body part 2 is formed from a thick metal plate, and forms a suitable fixing surface for the fixing device 1 to be connected to a wrapping machine. The vertically-extending groove 5 is formed in the body part 2 near a lower portion of the body part 2 (with respect to the orientation shown in FIG. 1, which also corresponds to the orientation of the fixing device 1 once connected to the wrapping machine). The groove 5 extends through the body part 2 in the horizontal direction.

The releasing part 4 is located below the bottom of the groove 5 and surrounds the lower portion of the body part 2 in a horizontal plane. The releasing part 4 is connected to the pneumatic cylinder 3 with the shaft 6. The pneumatic cylinder 3 is connected to the body part 2 with the connection part 7.

The releasing part 4 is movable in the vertical direction along the surfaces of the lower portion of the body part 2 between a lower position, which is shown in FIG. 1, and an upper position, not shown, with the pneumatic cylinder 3 through the shaft 6. When the releasing part 4 is in the upper position, the upper surface of the releasing part 4 is substantially in the area where the groove 5 starts, such that when the releasing part 4 is in the upper position the releasing part 4 substantially covers the whole area of the groove 5.

When the fixing device 1 connected to a wrapping machine, in operation, a knot is first tied in the end of the wrapping film web. Then, while the fixing device 1 is in the position shown in FIG. 1, the end of the wrapping film web is set in the groove 5 such that the tied knot is set against one of the side surfaces of the body part 2 connected with the groove 5. From the opposite side surface of the body part 2, the wrapping film web continues to a carriage of a roll of the wrapping film web. The knot tied in the end of the wrapping web prevents the wrapping web from prematurely escaping from the fixing device 1.

Next, the wrapping process is started with the operating system of the wrapping machine. The control system of the wrapping machine also controls the pneumatic cylinder 3 of the fixing device 1 such that when the first round of the wrapping film web is wrapped around a load to be wrapped after the wrapping process is started or restarted, the pneumatic cylinder 3 moves the releasing part 4 upwards. This causes the upper surface of the releasing part 4 to push the end of the wrapping film web together with the tied knot from the groove 5, thus releasing the end of the wrapping film web from the fixing device 1. After being released from the fixing device 1, the end of the wrapping film web falls against the load to be wrapped and is covered with following wrapping rounds of the wrapping film web.

Figure 2:
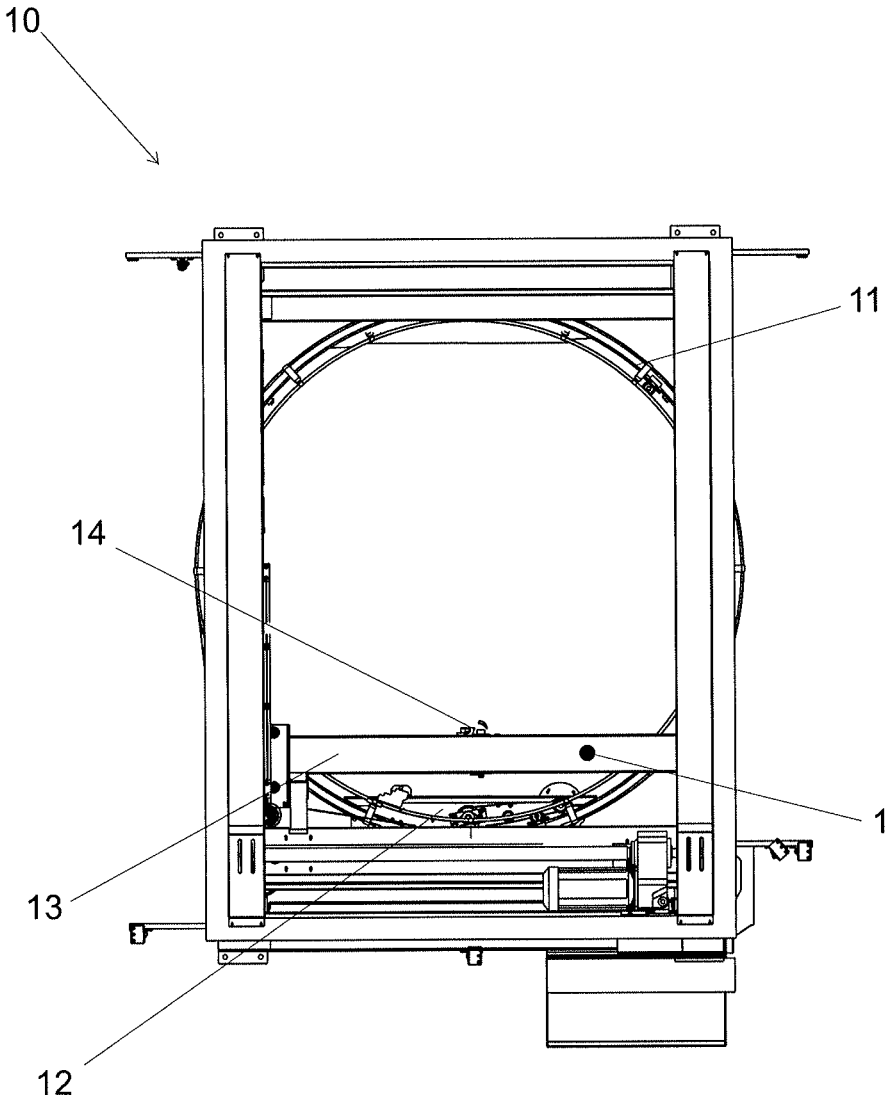
FIG. 2 is a top plan view of one embodiment of the wrapping machine of the present disclosure including the fixing device of FIG. 1.

FIG. 2 shows illustrates one embodiment of a wrapping machine 10 of the present disclosure including the fixing device 1. The wrapping machine 10 includes a circular guide 11 along which a wrapping film web roll carrier 12 is circulated for wrapping a load located in a wrapping area of the wrapping machine 10. The wrapping area of the wrapping machine 10 is the area inside the circular guide 11. During the wrapping process, the circular guide 11 together with the carrier 12 are moved in the vertical direction in order to cover the height of the load to be wrapped.

A portal beam 13 is located above the circular guide 11. A cutting and holding device 14 is connected to a bottom surface of the cutting and holding device 14. The cutting and holding device 14 is used at the end of the wrapping process such that, before the last round of wrapping material is wrapped, the cutting and holding device 14 is moved next to the wrapped load by moving the portal beam 13 towards the load. The last wrapping round is then wrapped such that the wrapping film web covers part of the cutting and holding device 14, which enables the cutting and holding device 14 to get hold of the wrapping film web. As a final step of the wrapping process, the cutting and holding device 14 cuts the wrapping film web, attaches the wrapped end of the wrapping film web to the wrapped load, and holds the other end of the wrapping film web ready for another wrapping process.

FIG. 2 illustrates the situation in which a roll of wrapping film web needs to be changed, such as when a new roll of wrapping film web needs to be installed to the carrier 12. The actual setting of a new wrapping film roll to the carrier 12 is a relatively simple procedure but, as described above, the burdensome part in prior art wrapping machines is attaching the end of the wrapping film web from the new roll to the cutting and holding device so that wrapping procedure may be continued. Specifically, attaching of the end of the new roll of wrapping film web to the cutting and holding device 14 is difficult since the carrier 12 is blocking some access to the cutting and holding device 14, since there is a load in the wrapping area of the wrapping machine 10, and since the parts of the cutting and holding device 14 need to be pried open. In this embodiment, the wrapping machine 10 is only accessible from one side, since the other sides of the wrapping machine are blocked with safety fences, further decreasing accessibility.

To overcome the problems with attaching the end of the new roll of wrapping film web to the cutting and holding device, the separate fixing device 1 is connected to the lower surface of the portal beam 13 at a place shown with a dot in FIG. 2. To properly operate and be usable in the wrapping process, the fixing device 1 needs to be within wrapping area of the wrapping machine 10, i.e. inside the circular guide 11.

As discussed above with respect to FIG. 1, the end of the new roll of wrapping film web can be easily inserted in the fixing device 1, and thus the wrapping process continued quickly.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A fixing device to which an end of a wrapping film web in a wrapping machine may be removably attached, the fixing device comprising:

a body defining a groove therethrough, wherein the groove is sized to receive the end of the wrapping film web;

a releaser supported by the body, wherein the releaser is movable relative to the body between a first position and a second position, wherein the releaser covers substantially all of the groove when the releaser is in the second position; and an actuator supported by the body and configured to move the releaser from the first position to the second position to discharge the end of the wrapping film web from the groove.

2. The fixing device of claim 1, which includes a connector attached to the body, the connector supporting the actuator.

3. The fixing device of claim 1, wherein the actuator includes a pneumatic cylinder.

4. The fixing device of claim 1, wherein the releaser is slidable along the body between the first position and the second position.

5. The fixing device of claim 1, wherein the releaser covers less than all of the groove when the releaser is in the first position.

6. The fixing device of claim 1, wherein the releaser covers substantially all of the groove when the releaser is in the second position such that the groove cannot receive the end of the wrapping film web.

7. The fixing device of claim 6, wherein the groove has an entrance, and wherein the releaser blocks the entrance when the releaser is in the second position such that the groove cannot receive the end of the wrapping film web.

8. A wrapping machine comprising:

a circular guide along which a roll of wrapping film web is movable;

a cutting and holding device configured to cut the wrapping film web and hold an end of the wrapping film web; and a fixing device separate from the cutting and holding device, the fixing device defining a groove sized to receive the end of the wrapping film web, the fixing device comprising a releaser movable from a first position to a second position to discharge the end of the wrapping film web from the groove after the wrapping machine has wrapped the wrapping film web around an object at least once, wherein the groove has an entrance, wherein the releaser blocks the entrance when in the second position such that the groove cannot receive the end of the wrapping film web.

9. The wrapping machine of claim 8, wherein the fixing device includes:

a body defining the groove therethrough; and an actuator supported by the body and configured to move the releaser between the first position and the second position.

10. The wrapping machine of claim 9, wherein the fixing device includes a connector attached to the body, the connector supporting the actuator.

11. The wrapping machine of claim 9, wherein the actuator includes a pneumatic cylinder.

12. The wrapping machine of claim 9, wherein the releaser covers substantially all of the groove when the releaser is in the second position.

13. The wrapping machine of claim 9, wherein the releaser covers less than all of the groove when the releaser is in the first position.

14. The wrapping machine of claim 8, wherein the releaser is slidable along the body from the first position to the second position.

15. A fixing device for a wrapping machine, the fixing device comprising:

a body defining a groove therethrough that is sized to receive an end of a wrapping film web;

a releaser supported by the body; and an actuator supported by the body and operably connected to the releaser to move the releaser from a first position to a second position to, when the end of the wrapping film web is received in the groove, push the end of the wrapping film web from the groove to detach the wrapping film web from the body.

16. The fixing device of claim 15, wherein the releaser covers substantially all of the groove when the releaser is in the second position.

17. The fixing device of claim 16, wherein the groove has an entrance, and wherein the releaser blocks the entrance when the releaser is in the second position such that the groove cannot receive the end of the wrapping film web.

18. The fixing device of claim 16, wherein the releaser covers less than all of the groove when the releaser is in the first position.

19. The fixing device of claim 15, wherein the actuator includes a pneumatic cylinder.

20. The fixing device of claim 15, wherein the releaser is slidable along the body from the first position to the second position.

* * * * *